United States Patent [19]

Curtin

[11] 4,304,229

[45] Dec. 8, 1981

[54] UNDERWATER-BREATHING DEVICE

[76] Inventor: David E. Curtin, 3034 College, Costa Mesa, Calif. 92626

[21] Appl. No.: 141,339

[22] Filed: Apr. 18, 1980

[51] Int. Cl.[3] ..... B63C 11/14; B63C 11/16

[52] U.S. Cl. ..... 128/201.11; 128/204.26; 128/205.24

[58] Field of Search ..... 128/201.11, 201.27, 128/204.26, 205.24, 200.19, 203.28; 137/625.48, 625.68

[56] References Cited

U.S. PATENT DOCUMENTS

| | | | |
|---|---|---|---|
| 39,812 | 9/1863 | Hayman | 137/625.48 |
| 1,310,094 | 7/1919 | Smith | 137/625.48 |
| 1,568,976 | 1/1926 | Jones et al. | 137/625.48 |
| 3,653,086 | 4/1972 | Gongwer | 128/201.11 |
| 4,111,197 | 9/1978 | Warncke et al. | 128/202.27 |

*Primary Examiner*—Henry J. Recla
*Attorney, Agent, or Firm*—Francis X. Lo Jacono

[57] ABSTRACT

An underwater-breathing device which combines the use of a snorkel with a scuba regulator to allow a skin diver to readily switch back and forth from the regulator to the snorkel as he alternates from deep diving to surfacing with his head submerged just a few inches below water surface, the breathing device comprising a two-way-selection valve having a mouthpiece formed therewith, and the valve being adapted to receive and connect to a scuba regulator at one point thereof and to a snorkel tube at a second point, whereby the diver can selectively employ either the scuba regulator or the snorkel by positioning the valve core within the valve housing.

4 Claims, 8 Drawing Figures

UNDERWATER-BREATHING DEVICE

BACKGROUND OF THE INVENTION

1. Field of the Invention

This invention relates generally to underwater-breathing devices, and more particularly to the combination of a snorkel and a scuba regulator selectively employed by means of a valve device having a mouthpiece formed as a part thereof.

2. Description of the Prior Art

As is well known in the art, various problems and difficulties are encountered when a diver desires to change from his deep-water-breathing apparatus to another one for use when he is submerged only a few inches below the surface of the water.

It is normally the practice for a skin diver to use scuba-diving equipment together with a separate snorkel device; and he must switch back and forth from one to the other, depending upon whether he is deep diving or is submerged just below the surface. The snorkel is a device popular with skin divers because it allows the user to breathe through it while submerged a few inches below the water's surface. More importantly, if he is to conserve his compressed-air supply, the diver must use his snorkel device—when possible—and not deplete his air tank.

The basic scuba-diving equipment comprises a breathing regulator having a mouthpiece, the regulator being operably connected to an air-supply tank by means of a tank valve. This apparatus is strapped to the diver and allows him to swim in deep water for long periods of time.

There are many types of snorkel devices; however, the basic snorkel consists of a mouthpiece connected to a breathing tube. The tube is generally bent in such a fashion as to be positioned to one side of the wearer's head, so that it extends upwardly above and beyond the head. Thus, when the diver's head is under water, the free end of the snorkel tube projects above the water's surface and into the air, allowing the diver to breathe ambient air.

When the scuba diver is preparing to descend into deeper water, he must exchange the mouthpiece of the snorkel for the mouthpiece of the breathing regulator connected to his air tank. He then breathes through the regulator until he returns to the surface, at which time he places the snorkel mouthpiece back in his mouth for breathing.

Many types of snorkel devices are used at the present time, but a study of these devices, and a review of issued patents in classes and sub-classes 405/185, 186; 128/201.11 and 9/313, have shown that there is at present no combined arrangement of a scuba regulator with a snorkel device. Several snorkels reveal modifications to prevent the entrance of water into the snorkel, or to facilitate water removal from the tube. Other changes relate to the different kinds of mouthpieces, etc. However, these improvements have not altered the basic function of the snorkel device. Thus, until the advent of the present invention, the snorkel had remained a useful but single-purpose device, with a very limited application.

SUMMARY AND OBJECTS OF THE INVENTION

The present underwater-breathing apparatus has for an important object to provide for a unique arrangement of the conventional snorkel, transforming it from the previous single-function device to a dual-function one by integrating the snorkel with the scuba-breathing regulator, so that with the combined breathing system the diver need not alternate mouthpieces while diving.

This combined system consists of a single mouthpiece including a two-way valve having an air inlet connected to a snorkel tube to allow the diver to breathe ambient air while at the surface of the water, and a second inlet connected to a scuba regulator to permit him to breathe from the air-supply tank while in deep water. Thus, the diver can selectively alternate to breathing either through the regulator or through the snorkel tube by means of the valve incorporated into the snorkel. As the diver prepares to descend, he operates the slidable valve core to direct his breathing through an aligned passage in the valve core to the regulator, until he returns to the surface—at which time the core valve is moved to allow a second passage to divert air from the snorkel tube through the single mouthpiece.

Thus, it is another object of the invention to provide a device of this character that, when used in conjunction with the regulator, facilitates underwater breathing by eliminating the need for changing mouthpieces. Rather than trailing off behind the diver when not in use, the regulator remains attached and is instantly available for use whenever the diver desires to swim in deeper water.

It is a further object of the invention to provide an underwater-breathing device of this type that requires relatively few operating parts.

It is still a further object of the invention to provide a device of this character that is easy to service and maintain, and that is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
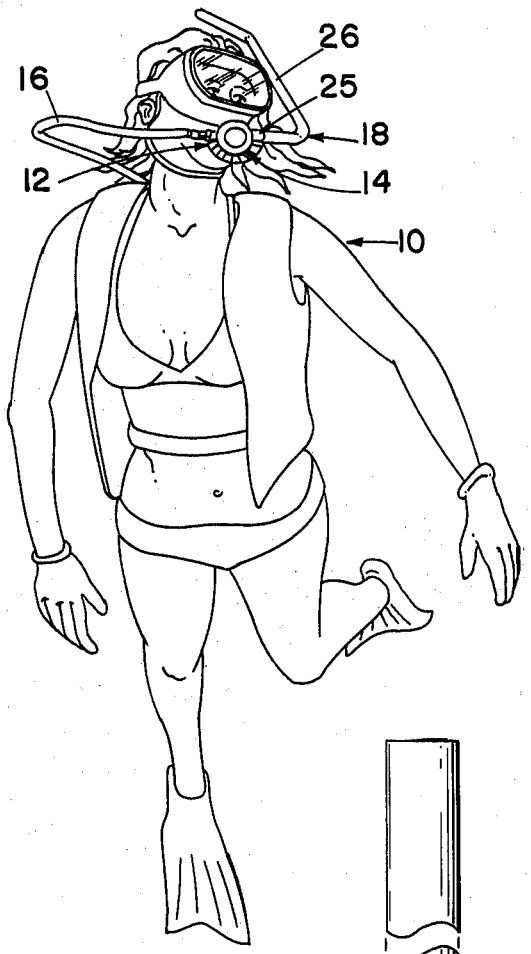
FIG. 1 is a pictorial view of a skin diver using the combination snorkel and scuba regulator having a common mouthpiece.

Referring more particularly to FIG. 1, there is shown a skin diver, indicated at 10, wearing the combination device as presently described. The diver is shown having the breathing system supplying air by means of the scuba device, generally designated at 12.

The breathing apparatus comprises the combination of a typical scuba regulator 14 connected by air hose 16 to an air-supply tank (not shown, but well understood in the art), the tank being strapped to the back of the diver. The scuba regulator is also attached to the new improved snorkel device, indicated generally at 18, wherein a single mouthpiece 20 is arranged to selectively receive air through regulator 14 or through the snorkel device 18.

Since scuba regulators vary in construction and are generally well known in the art, a detailed discussion of the operation is not felt to be necessary.

Figure 2:
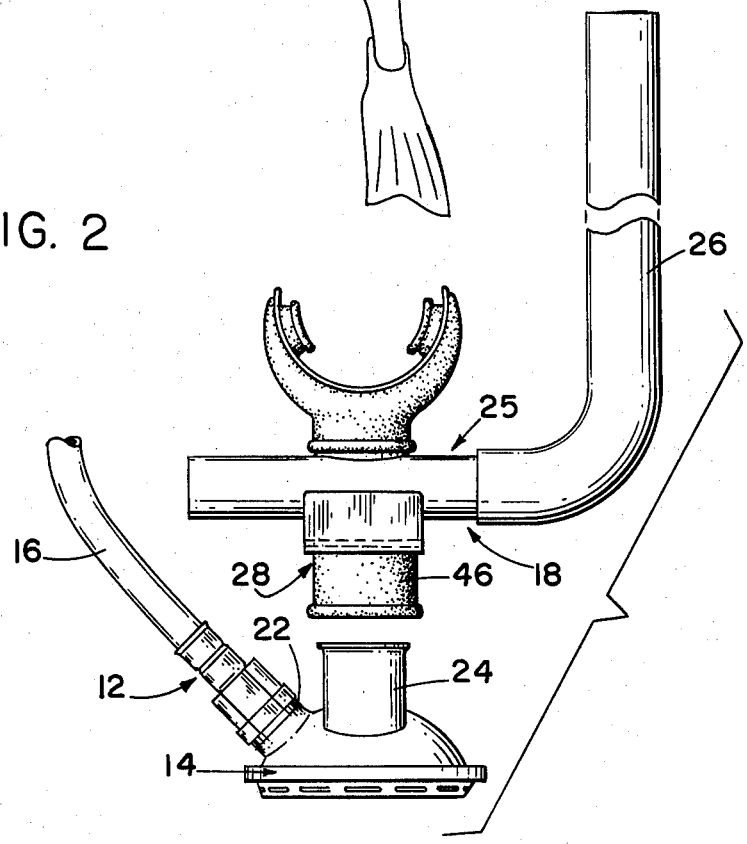
FIG. 2 is a top-plan view of the snorkel device and the scuba regulator, prior to being connected.
Figure 3:
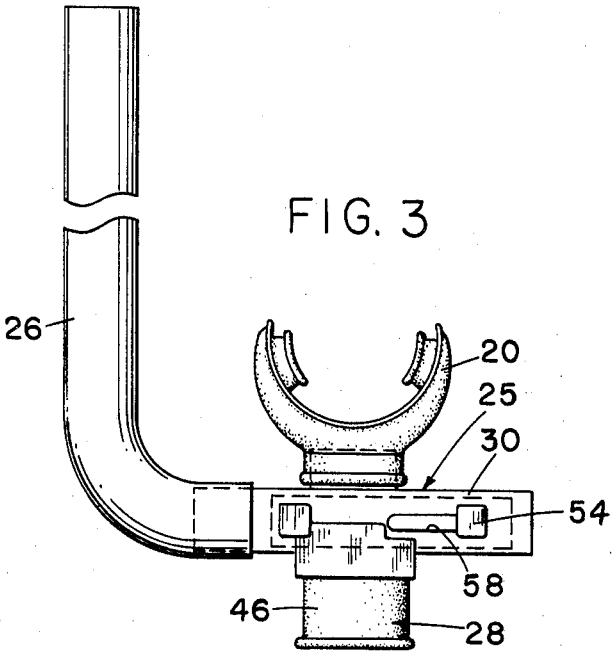
FIG. 3 is a bottom-plan view of the snorkel device.
Figure 4:
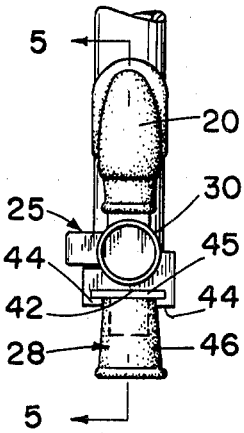
FIG. 4 is a right-side-elevational view thereof.

The present scuba regulator 14 is adapted with an air inlet 22 which is connected to hose 16, allowing air to flow therethrough and exit from outlet port 24, as seen in FIG. 2.

The improved snorkel device 18 comprises a two-way selection valve means, designated at 25, which is adapted to support a typical snorkel tube 26, mouthpiece 20, and a coupling means 28. Valve means 25 comprises a tubular valve housing 30 defining a longitudinal bore 32 having an end port 33, and oppositely disposed side ports 34 and 36 which are located intermediate the ends of housing 30. Port 34 is provided with an outwardly extended neck member 38 on which is mounted mouthpiece 20, the mouthpiece having an aligned opening 40. The oppositely disposed port 36 includes means for removably securing coupling means 28 to the snorkel device. Port 36 is provided with a channel 42 defined by side flanges 44 which are adapted to receive coupling-insert member 45, the insert being formed as part of coupling sleeve 46.

After coupling sleeve 46 is mounted to neck member 38, the snorkel device can be readily separated from regulator 14 by slidingly disengaging the coupling-insert member 45 from the channel 42.

Figure 5:
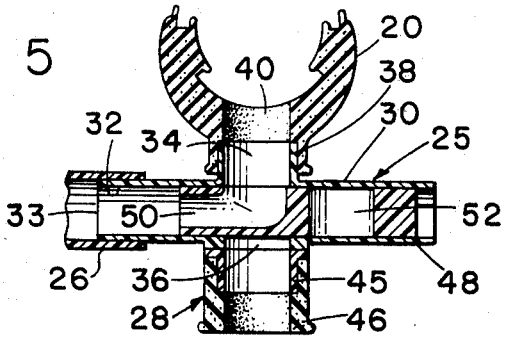
FIG. 5 is a cross-sectional view taken substantially along line 5—5 of FIG. 4, showing the valve core in a position to allow air to flow through the snorkel tube.

In order to provide for the selective breathing of either ambient air or tank-supplied air, valve means 25 further includes a valve core 48 that is slidably received in bore 32, valve 25 having means to allow the diver to selectively slide the core from one position to another and valve core 48 being provided with two air passages 50 and 52. Air passage 50 is formed having a substantially "L"-shaped configuration and is positioned at one end of the valve core, whereby air can pass between the side of the core and the end of the core, thus allowing air to be breathed through snorkel tube 26. That is, when valve core 48 is positioned to the far right (as seen in FIG. 5), passage 50 permits air to flow between snorkel tube 26 and mouthpiece 20.

Figure 6:
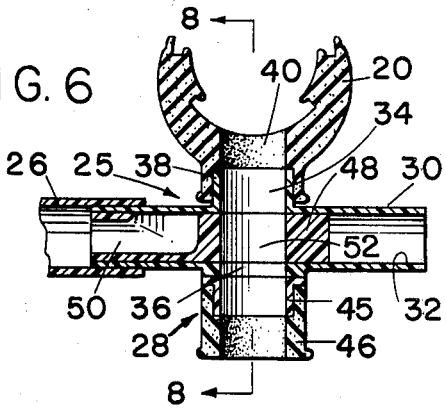
FIG. 6 is a cross-sectional view similar to that of FIG. 5, wherein the valve core is positioned to provide communication between the mouthpiece and the scuba regulator.
Figure 7:
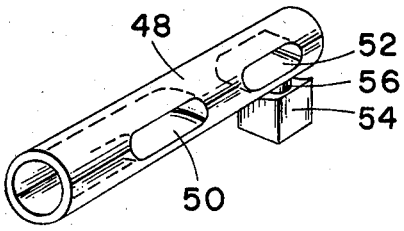
FIG. 7 is a perspective view of the valve core.
Figure 8:
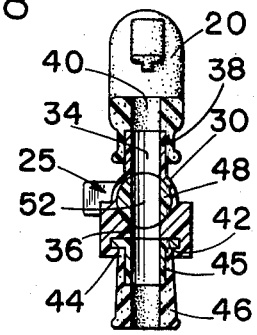
FIG. 8 is a cross-sectional view taken substantially along line 8—8 of FIG. 6.

Accordingly, when valve core 48 is moved to the left (as shown in FIG. 6), passage 52 is at this time aligned between opening 40 of mouthpiece 20 and port 36, whereby port 36 communicates with scuba regulator 14. Means for selectively positioning the valve core 48 comprises a control knob 54 secured to the underside of the core by pin 56. Pin 56 is slidably positioned in a longitudinal slot 58 formed in valve housing 30 which allows the core 48 to be moved from one position to the other. The location of slot 58 and pin 56 prevents rotation of core 48, so that both passages are always horizontally positioned for alignment with port 34.

It should be noted that the valve housing and the valve core can be formed from any suitable material; but it is contemplated that each member will be made from compatible plastic materials, so that no pressure-sealing means would be required therebetween.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. An underwater-breathing device for attachment to a scuba regulator for selectively breathing either stored air from an air tank while the diver is in deep water, or ambient air through a snorkel while he is submerged just uner the surface of the water, the device comprising:

a snorkel tube adapted to allow the passage of air therethrough when the open end thereof is disposed just above the water surface;

a scuba regulator adapted to be interconnected to said snorkel tube;

a mouthpiece for receiving air from said snorkel tube or said scuba regulator;

a valve means for selectively allowing air flow from said air tank or said ambient air through said snorkel, said valve means having a first, a second, and a third port, wherein said first port communicates with said snorkel tube, said second port communicates with said mouthpiece, and said third port communicates with said scuba regulator, and wherein said valve means comprises;

a valve housing having a longitudinal bore formed therein, said first port being formed at one end of said longitudinal bore, and said second and third ports being oppositely disposed to each other and positioned intermediate the ends of said longitudinal bore; and a valve core slidably disposed in said longitudinal bore having first and second air-flow passages arranged to be selectively positioned between respective ports of said housing, said first air-flow passage being adapted to allow communication between said first and second ports when said valve core is positioned to allow air to pass from said snorkel tube through said mouthpiece, and said second air-flow passage being adapted to allow communication between said second and third ports when said valve core is positioned to allow air to pass from said regulator through said mouthpiece;

means for selectively positioning said valve means to allow air to flow between said first and said second ports, and said second and said third ports;

wherein said means for selectively positioning said valve means comprises:

a pin member attached to said valve core;

a knob member secured to said pin; and an elongated slot formed in said valve housing to receive said pin therethrough, whereby said pin can move longitudinally therein to provide longitudinal movement to said valve core for selectively aligning said flow passages with respective corresponding ports; and a detachable coupling means is interposed between said third port and said scuba regulator.

2. An underwater-breathing device as recited in claim 1, wherein said first air-flow passage is formed to communicate between said first and said second ports, whereby air will flow between said snorkel tube and said mouthpiece; and wherein said second air-flow passage is formed to communicate between said second and said third ports; whereby air will flow between said mouthpiece and said regulator.

3. An underwater-breathing device as recited in claim 2, wherein said first air-flow passage is formed angularly within said valve core, said passage having a side opening to correspond to said second port and an end opening to communicate with said first port; and wherein said second passage is disposed transversely of said core, in order to be interpositioned to communicate between said second and said third ports of said housing.

4. An underwater-breathing device as recited in claim 1, wherein said detachable coupling means comprises:

a channel formed in said valve housing adjacent said third port; and a coupling sleeve having a coupling-insert member adapted to be removably mounted to said channel, said coupling sleeve being affixed to said regulator.

* * * * *